US006446582B1

(12) United States Patent
Duong et al.

(10) Patent No.: US 6,446,582 B1
(45) Date of Patent: Sep. 10, 2002

(54) FUEL FEEDLINE AND VAPOR BARRIER ASSEMBLY

(75) Inventors: Thach Duong, Garden Grove; Conrad Boehnlein; Robert W. Lewis, both of Gardena, all of CA (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 09/696,107

(22) Filed: Oct. 24, 2000

(51) Int. Cl.[7] ..... F22B 5/04
(52) U.S. Cl. ..... 122/17.1; 122/13.01; 122/497
(58) Field of Search ..... 122/13.01, 17.1, 122/17.2, 18.4, 235.13, 428, 497, 498; 126/350.1, 390.1

(56) References Cited

U.S. PATENT DOCUMENTS

| | | | | |
|---|---|---|---|---|
| 5,099,825 A | * | 3/1992 | Massey et al. | 126/383 |
| 5,499,621 A | * | 3/1996 | Trihey | 122/17.1 |
| 6,109,216 A | | 8/2000 | Reynolds et al. | |
| 6,216,643 B1 | * | 4/2001 | Reynolds et al. | 122/13.01 |
| 6,244,223 B1 | * | 6/2001 | Welk | 122/13.01 |
| 6,269,779 B2 | * | 8/2001 | Overby. Jr. | 122/13.01 |

* cited by examiner

*Primary Examiner*—Gregory Wilson
(74) *Attorney, Agent, or Firm*—Fulwider Patton Lee & Utecht

(57) ABSTRACT

An apparatus and method for extending a gas feedline through a vapor barrier enclosure simplifies and reduces the costs associated with manufacture and installation while establishing a seal between the vapor barrier and the feedline.

17 Claims, 1 Drawing Sheet

FUEL FEEDLINE AND VAPOR BARRIER ASSEMBLY

BACKGROUND OF THE INVENTION

The present invention generally relates to the extension of a gas feedline through a vapor barrier to interconnect a fuel source with the burner of a gas-burning appliance. More particularly, the invention pertains to a configuration that simplifies the installation of a gas feedline while establishing a seal between the gas line and the vapor barrier.

A potential hazard inherent in the operation of a gas-burning appliance is that it may cause flammable vapors to ignite that happen to collect in and around the appliance. Ignition may either be caused by the burner or pilot flame or by an electric or electronic ignitor upon being energized. This is especially problematic in for example water heaters or furnaces that are located in garages in which cars are parked where the leakage or spillage of gasoline may occur. Once a combustible mixture reaches the appliance, a fire or an explosion may result.

Efforts to address this potential safety hazard have been previously directed toward ensuring adequate ventilation in and around the appliance, the elevation of the appliance to distance it from flammable vapors that are denser than air, and more recently, the isolation or sealing of the combustion chamber from its surroundings. This latter approach not only prevents the incursion of vapors into the combustion chamber but also prevents the propagation of flame therefrom.

A difficulty associated with effectively sealing the combustion chamber of a typical gas-burning appliance is inherent in the necessity for various conduits to extend into the combustion chamber from the exterior of the appliance. The fitment of a sheet metal enclosure about the entire combustion chamber is typically relied upon to form a vapor barrier. The extension of any conduit through such barrier requires that an appropriate opening be formed in the barrier and that any gap between the installed conduit and the surrounding barrier material be substantially closed off. In the case of the extension of a gas feedline through such barrier, it is additionally necessary for there be some freedom of movement between the gas line and the barrier to facilitate installation. Moreover, only a minimal number of relatively inexpensive components which require only a minimal amount of labor to assemble should be required to provide an effectively sealed interface. The components associated with the sealing of the gap should be immune to deterioration during the service life of the appliance. Accordingly, the sealed interface must be capable of withstanding the elevated temperatures it is routinely subjected to due to its proximity to flame and must additionally be able to withstand even higher temperatures as may be mandated by various regulating agencies with regard to fire safety.

An approach that has previously been employed requires the use of a multi-piece feedline. A rigid length of feed line extending from an opening formed in the barrier inwardly toward the burner is first attached to the barrier such that a male fitting formed or attached to the proximal end of such length of feedline extends through such opening. A flange that is affixed to the fitting is staked to the outside surface of the barrier to form a seal. In order to impart the necessary flexibility to the assembly, a length of flex line is threaded onto the protruding fitting while its proximal end is threaded onto the gas controller/valve to complete the assembly. The multi-piece, multi-step assembly process is labor intensive and requires a number of rather expensive components. Additionally, every coupling is a potential source of leakage while the flex line is relatively fragile.

A mechanism is required that reduces the costs involved in the assembly of feedline to and through the vapor barrier of for example a water heater. A desirable configuration would require a minimal number of parts and a minimal amount of labor while nonetheless being capable of fulfilling the requirements with regard to maintaining the integrity of the seal established by the barrier.

SUMMARY OF THE INVENTION

The present invention overcomes the shortcomings of previous mechanisms that have been employed for extending a gas feedline through a vapor barrier while effectively preserving the integrity of the seal established by such barrier. This is achieved with the use of a minimal number of components while only a minimal amount of manual labor is required in their assembly.

The present invention employs a single rigid conduit for delivering a combustible gas from the gas controller valve to the burner. The conduit passes through an aperture in a flat metallic grommet that is crimped into place within a raised collar formed in a removable section of barrier material. The minimal clearance between the grommet and conduit precludes appreciable leakage there between while the contour of the inner edge of the grommet allows the conduit to be readily shifted and pivoted relative to the grommet to facilitate assembly and installation.

By employing a single rigid conduit to route gas from the controller valve to the burner, the total number of components that had previously been required is reduced including the elimination of a relatively expensive threaded coupling. Moreover, no assembly of multiple sections of conduit is required. The elimination of a coupling also serves to eliminate a potential source of leakage. Additionally, with the use of the grommet of the present invention configured to impart a degree of freedom of movement to the conduit, the need to use a length of expensive and less robust flex line is obviated.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The present invention allows a gas feedline to be passed through a vapor barrier without compromising the barrier's ability to prevent the passage of significant amounts of flammable vapors there through or the propagation of flame there across. In the most preferred embodiment, the feedline and a section of barrier in conjunction with a specially configured grommet element are preassembled, requiring only the attachment of the entire assembly to for example a water heater.

Figure 1:
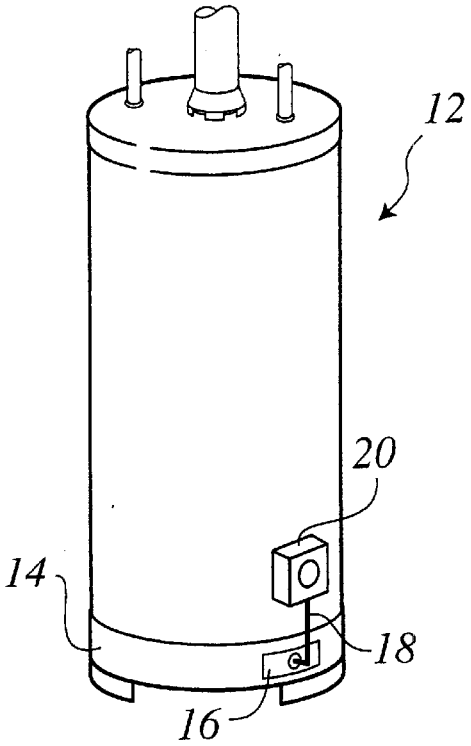
FIG. 1 illustrates the feedline/door assembly of the present invention in place on a water heater having a fully enclosed combustion chamber.

FIG. 1 is a perspective view of a water heater 12 having a vapor barrier enclosure 14 fitted about its combustion chamber. A door or removable access panel 16 is fitted to the enclosure to permit access to components positioned therein. A gas feedline 18 extends from a gas controller valve 20 to the burner located within the combustion chamber.

Figure 2:
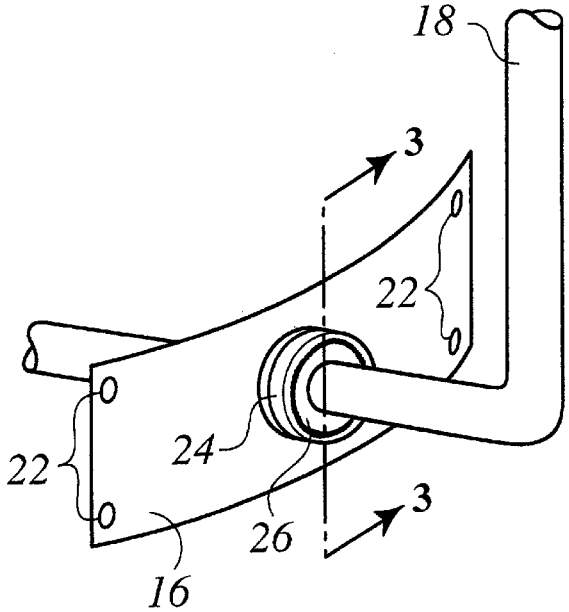
FIG. 2 is an enlarged perspective view of the feedline/door assembly.

FIG. 2 is an enlarged perspective view of the access panel 16 visible in FIG. 1 providing some detail regarding the interface between the feedline 18 and the access panel 16. The opening formed in the vapor barrier enclosure and hence the access panel or door are dimensioned to allow access into the interior of the combustion chamber so as to enable the trouble shooting and/or replacement of the various components located therein, including for example the burner, pilot, ignitor, thermocouple or thermopile. Elongated openings 22 are shown formed at the four corners of the panel which are dimensioned for receipt of fasteners there through for the purpose of attaching the panel to the surrounding barrier 14. The panel has a slightly curved shape that conforms to the curvature of the enclosure.

A circular raised collar 24 extends outwardly from the surface of the panel 16 while a flat grommet 26 is firmly held in place therein. A central aperture 28 formed in the grommet, is dimensioned to receive the feedline 18 there through. The clearance between the inner diameter of the opening 28 and the outer diameter of the feedline is selected to limit any leakage past the barrier to allowable levels while providing sufficient clearance to enable the feedline to be longitudinal shifted therein.

Figure 3:
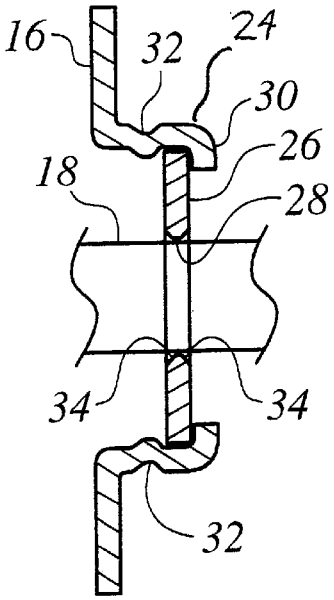
FIG. 3 is a greatly enlarged cross-sectional view taken along lines III—III of FIG. 2.

FIG. 3 is a cross-sectional view taken along lines III—III of FIG. 2. The view clearly shows the grommet 26 as it is held in place within collar 24 by a combination of a lip 30 and crimp 32 that both extend about the entire periphery of the collar. The height of the collar is selected to allow such crimp to extend slightly under the edge of the grommet to ensure a positive retention thereof. The view also shows the bevels 34 formed on both sides of the grommet. Such bevels allows the feedpipe 18 to be angled or pivoted within opening 28 without the necessity to increase the clearance between inner diameter of the aperture and the outer diameter of the feedpipe. The bevels also serve to allow the feedpipe to be more readily longitudinally shifted relative to the grommet as angular misalignment thereof could otherwise cause binding.

Figure 4:
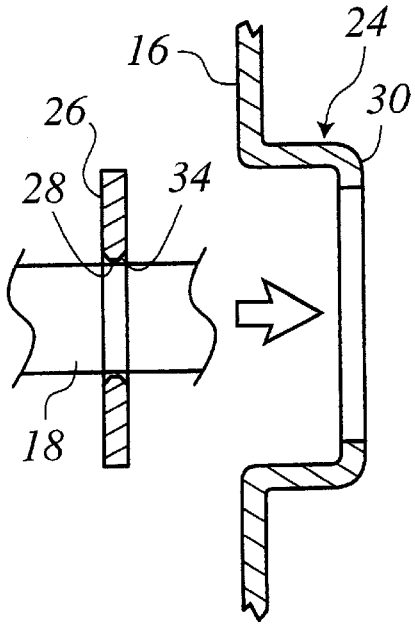
FIG. 4 is a greatly enlarged cross-sectional view of the components of the present invention prior to completion of assembly.

The manufacture and assembly of the various components is accomplished as follows. The access panel 16 is first stamped and worked so as to form a hole surrounded by the raised collar 24, the elongated mounting holes 22 and an overall curvature so as to conform to the curvature of the enclosure 14 to which it is to be fitted. As is shown in FIG. 4, the collar is preferably formed to a height of 0.175" while the inwardly extending lip 30 about the periphery of the collar has a width of 0.050". The access panel is preferably formed of 18 gauge sheet metal. The flat grommet is preferably formed of 0.085" galvanized steel or stainless steel, is 1.00" in diameter, has an aperture 28 formed therein having a diameter that is 0.015" greater than the diameter of the feedpipe that it is to accommodate. The bevels 34 are preferably 0.025" wide with 45° chamfer and are preferably formed by coining during the stamping of the grommet. The feedline 18 is extended through aperture 28 formed in the grommet 26 after which the forming of the feedline is completed, either by deformation of the burner engaging end or after the fitment of a coupling element to the end that is to be attached to the gas controller valve. The coupling with which the feedline is to be connected to the controller gas valve is sized so as to be extendable past the inwardly extending lips 30 of collar 24. The grommet is then positioned within the collar after which a crimping device is utilized to form crimp 32 about the collar to positively hold the grommet in place.

Such assembly may then be installed in the gas-fired appliance. The burner engaging end of the feedpipe 18 is first inserted into the combustion chamber of the appliance through the opening formed in the enclosure 14 that will become closed off by the fitment of access panel 16. The proximal end of the feedline is then interconnected to the gas controller valve 20 after which the access panel 16 is shifted into place along the feedline and attached to the enclosure with the extension of the appropriate fasteners through mounting holes 22. The bevels 34 formed in the grommet 26 allow the access panel to be more readily shifted along the feedline and further allows the access panel to be angled or pivoted relative to the feedline should that become necessary during the positioning of the various components. The elongated shape of the openings 22 serves to accommodate any tolerance stack up in the dimensions of the various components and with regard to their relative positions.

A tight seal is achieved between the access panel 16 and surrounding enclosure material 14 to substantially preclude the leakage of any vapors there between. An appropriate gasket material may be fitted to ensure a positive seal. The crimp 32 causes the collar 24 to positively engage the outer diameter of the grommet 26 about its entire circumference and thereby precludes the leakage of any vapors there between. In the case of a 0.5" feedline, the 0.015" diameter oversize of aperture 28 in grommet 26 equates to a maximum radial gap of 0.015". An air gap of 0.015" or smaller is an adequate seal for a combustion chamber for gas-fired appliances of this type. Such orifice equivalent has been deemed well within the maximum allowable per regulations that address the enclosure and sealing of combustion chambers for gas-fired appliances. The steel grommet is not subject to deterioration over the service life of the associated appliance and is not effected by the heat it may be exposed to due to its proximity to a burner. Additionally, due to its all-metal construction, the assembly will continue to maintain a seal despite being subjected to the elevated temperatures it may be exposed to during a fire.

While a particular form of the invention has been illustrated and described, it will also be apparent to those skilled in the art that various modifications can be made without departing from the spirit and scope of the invention. More particularly, the components of the present invention my be formed from a variety of different materials, are not limited to any particular dimensions and the invention may be adapted to any of a variety of different gas-fired appliances. Accordingly, it is not intended that the invention be limited except by the appended claims.

What is claimed is:

1. A fuel feedline assembly for attachment to a gas-fired appliance having an enclosure about a combustion chamber, such enclosure having an access opening formed therein, comprising:

an access panel dimensioned to cover said access opening and having a hole formed therein surrounded by a raised collar;

a flat grommet having a central aperture formed therein and retained in said collar; and a tubular fuel conduit extending through said aperture formed in said grommet wherein said grommet has a thickness greater than that of said access panel.

2. The assembly of claim 1, wherein said collar formed in said access panel has an inwardly extending lip formed about its periphery.

3. The assembly of claim 2, wherein said collar is crimped so as to retain said grommet between said crimp and said lip.

4. The assembly of claim 1, wherein said central aperture of said grommet has a bevel formed there about.

5. The assembly of claim 4, wherein said central aperture of said grommet has a bevel formed thereabout on both sides.

6. The assembly of claim 1, wherein the diameter of said central aperture in said grommet exceeds the diameter of said tubular feedline by approximately 0.015".

7. The assembly of claim 1, wherein said access panel has elongated openings formed therein to accommodate fasteners for attachment to said enclosure while allowing said access panel to be shifted relative to said enclosure.

8. The assembly of claim 1, wherein said access panel is formed of sheet metal.

9. The assembly of claim 1, wherein said grommet is formed of galvanized steel.

10. A method of extending a conduit through a sheet metal barrier, comprising the steps of:

deforming said sheet metal barrier so as to define a hole therein surrounded by a raised collar;

inserting; into said raised collar, a flat grommet having a central aperture formed therein dimensioned to receive said conduit there through; and crimping said collar about said grommet.

11. The method of claim 10, wherein conduit is extended through said aperture in said flat grommet before said grommet is inserted into said collar.

12. The method of claim 10, wherein said grommet has a thickness greater than the thickness of said sheet metal barrier.

13. The method of claim 10, wherein said sheet metal barrier is deformed so as to define an inwardly extending lip extending about said raised collar to retain said grommet upon insertion into said collar.

14. The method of claim 10, wherein said aperture is dimensioned such that its diameter is approximately 0.015" greater than the diameter of said conduit.

15. The method of claim 10, wherein said grommet has a bevel formed about said central aperture.

16. The method of claim 15, wherein said grommet has a bevel formed about said central aperture on both sides of said grommet.

17. The method of claim 10, further comprising the step of fitting the assembly of sheet metal barrier, grommet and conduit to a gas-fired appliance.

* * * * *